US011761311B2

(12) United States Patent
Xia

(10) Patent No.: US 11,761,311 B2
(45) Date of Patent: Sep. 19, 2023

(54) PERFORATION CLUSTER LAYOUT DESIGN AND ITS RELATIVE ORIENTATION IN THE SUBSURFACE FOR A HYDRAULIC FRACTURING TREATMENT

(71) Applicant: Saudi Arabian Oil Company, Dhahran (SA)

(72) Inventor: Kaiming Xia, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/457,567

(22) Filed: Dec. 3, 2021

(65) Prior Publication Data

US 2023/0175359 A1 Jun. 8, 2023

(51) Int. Cl.
*E21B 43/116* (2006.01)
*E21B 43/112* (2006.01)
(Continued)

(52) U.S. Cl.
CPC ..... *E21B 43/116* (2013.01); *E21B 43/112* (2013.01); *E21B 43/117* (2013.01); *E21B 43/11* (2013.01)

(58) Field of Classification Search
CPC ..... E21B 43/11; E21B 43/112; E21B 43/117; E21B 43/118; E21B 7/14; E21B 7/15; E21B 43/116
See application file for complete search history.

(56) References Cited

U.S. PATENT DOCUMENTS 5,499,678 A * 3/1996 Surjaatmadja ..... E21B 43/26 166/308.1
9,121,272 B2 9/2015 Potapenko et al.
(Continued)

FOREIGN PATENT DOCUMENTS

CN 110714746 B 8/2021
WO 2018048415 A1 3/2018

OTHER PUBLICATIONS

Jianguang Wei et al., "A multi-perforation staged fracturing experimental study on hydraulic fracture initiation and propagation", Energy Exploration & Exploitation, Nov. 2020, pp. 2466-2484.
(Continued)

*Primary Examiner* — Yong-Suk (Philip) Ro
(74) *Attorney, Agent, or Firm* — Leason Ellis LLP

(57) ABSTRACT

A perforation cluster of a longitudinal section of a wellbore is provided. The wellbore is for hydraulic fracturing in a preferred direction of a subsurface surrounding the longitudinal section. The longitudinal section has a longitudinal axis in a longitudinal direction and defining a radial direction about the longitudinal axis. The perforation cluster includes all of the perforations of the wellbore within the longitudinal section. The perforations are separated in the longitudinal and radial directions. Two perforations are adjacent in the longitudinal direction and have a first diameter. They also have respective centers that are aligned in the preferred direction with respect to the longitudinal axis and 180° apart in the radial direction, for initiating fractures through hydraulic fracturing in the subsurface. The remaining perforations have a second diameter smaller than the first diameter.

9 Claims, 5 Drawing Sheets

(51) Int. Cl.
*E21B 43/117* (2006.01)
*E21B 43/11* (2006.01)

(56) References Cited

U.S. PATENT DOCUMENTS

| | | | |
|---|---|---|---|
| 9,963,955 | B2 | 5/2018 | Tolman et al. |
| 10,018,025 | B2 | 7/2018 | Ciezobka et al. |
| 10,174,602 | B2 | 1/2019 | Maxey et al. |
| 10,760,416 | B2 | 9/2020 | Weng et al. |
| 2016/0312594 | A1 | 10/2016 | Kuchuk et al. |
| 2017/0074998 | A1 | 3/2017 | McColpin et al. |
| 2020/0300072 | A1 | 9/2020 | Snider et al. |
| 2021/0073314 | A1 | 3/2021 | Ray et al. |

OTHER PUBLICATIONS

Hongjie Xiong, "Optimizing Cluster or Fracture Spacing: An Overview", https://jpt.spe.org/twa/optimizing-cluster-or-fracture-spacing_overview, May 24, 2017.

* cited by examiner

Phase angle: 60°

PERFORATION CLUSTER LAYOUT DESIGN AND ITS RELATIVE ORIENTATION IN THE SUBSURFACE FOR A HYDRAULIC FRACTURING TREATMENT

FIELD OF THE DISCLOSURE

The present disclosure relates in general to hydraulic fracturing, and, more specifically, to a perforation cluster layout design and its relative orientation in the subsurface for a hydraulic fracturing treatment.

BACKGROUND OF THE DISCLOSURE

In the field of oil and gas wells, subsurface petroleum and natural gas deposits may be difficult to extract, such as when they are trapped by bedrock. To this end, hydraulic fracturing (also known as "fracking") is used to create cracks in deep rock formations. Hydraulic fracturing uses high-pressure injection of fracking fluid (e.g., water mixed with sand or aluminum oxide) to create the cracks. The cracks have sufficient size and conductivity to allow the trapped petroleum and natural gas to flow more freely, enabling their extraction. However, hydraulic fracture initiation can be a challenging issue for deep and tight gas reservoirs. For instance, the fracking fluid is usually injected through perforations in the wellbore. The size and layout of the perforations (also referred to as the perforation cluster) play a crucial role in the effectiveness of the hydraulic fracturing.

It is in regard to these and other problems in the art that the present disclosure is directed to provide a technical solution for an effective perforation cluster layout design and its relative orientation in the subsurface for a hydraulic fracturing treatment.

SUMMARY OF THE DISCLOSURE

According to a first aspect of the disclosure, a perforation cluster of a longitudinal section of a wellbore for hydraulic fracturing in a preferred direction of a subsurface surrounding the longitudinal section is provided. The longitudinal section has a longitudinal axis in a longitudinal direction and defining a radial direction about the longitudinal axis. The perforation cluster comprises all of a plurality of perforations of the wellbore within the longitudinal section. The plurality of perforations are separated in the longitudinal and radial directions. The plurality of perforations consists of a first perforation, a second perforation, and remaining perforations. The first and second perforations are adjacent perforations in the longitudinal direction from among the plurality of perforations. The first and second perforations have a first diameter in the wellbore. The first and second perforations have respective centers that are aligned in the preferred direction with respect to the longitudinal axis and 180° apart in the radial direction, for initiating fractures through hydraulic fracturing in the subsurface. The remaining perforations have a second diameter in the wellbore smaller than the first diameter.

In an embodiment consistent with the above, the longitudinal section is a horizontal portion of the wellbore with respect to gravity.

In an embodiment consistent with the above, adjacent perforations in the longitudinal direction from among the plurality of perforations are at least 90° apart in the radial direction.

In an embodiment consistent with the above, adjacent perforations in the longitudinal direction from among the plurality of perforations are equidistant in the longitudinal direction.

In an embodiment consistent with the above, adjacent perforations in the radial direction from among the plurality of perforations are equidistant in the radial direction, and adjacent perforations in the longitudinal direction and not adjacent in the radial direction.

In an embodiment consistent with the above, a center of each of the remaining perforations is 180° apart in the radial direction from a center of another of the remaining perforations.

In an embodiment consistent with the above, each pair of perforations whose respective centers are 180° apart in the radial direction are adjacent in the longitudinal direction.

In an embodiment consistent with the above, the remaining perforations comprise a third perforation, a fourth perforation, a fifth perforation, and a sixth perforation. The third and fourth perforations are a pair of perforations whose respective centers are 180° apart in the radial direction and are on one side of the longitudinal section with respect to the first and second perforations. The fifth and sixth perforations are a pair of perforations whose respective centers are 180° apart in the radial direction and are on another side of the longitudinal section with respect to the first and second perforations.

In an embodiment consistent with the above, adjacent perforations in the longitudinal direction from among the plurality of perforations are equidistant in the longitudinal direction.

In an embodiment consistent with the above, adjacent perforations in the radial direction from among the plurality of perforations are equidistant in the radial direction, and adjacent perforations in the longitudinal direction and not adjacent in the radial direction.

In an embodiment consistent with the above, adjacent perforations in the longitudinal direction from among the plurality of perforations are at least 120° apart in the radial direction.

According to a second aspect of the disclosure, a perforation cluster of a longitudinal section of a wellbore for hydraulic fracturing in a preferred direction of a subsurface surrounding the longitudinal section is provided. The longitudinal section has a longitudinal axis in a longitudinal direction and defining a radial direction about the longitudinal axis. The perforation cluster comprises all of six perforations of the wellbore within the longitudinal section. The six perforations are separated in the longitudinal and radial directions. The six perforations comprise a first perforation, a second perforation, a third perforation, a fourth perforation, a fifth perforation, and a sixth perforation. The first and second perforations are adjacent perforations in the longitudinal direction from among the six perforations. The first and second perforations have a first diameter in the wellbore. The first and second perforations have respective centers that are aligned in the preferred direction with respect to the longitudinal axis and 180° apart in the radial direction, for initiating fractures through hydraulic fracturing in the subsurface. The third, fourth, fifth, and sixth perforations have smaller diameters in the wellbore than the first diameter.

In an embodiment consistent with the second perforation cluster described above, the longitudinal section is a horizontal portion of the wellbore with respect to gravity.

In an embodiment consistent with the second perforation cluster described above, adjacent perforations in the longitudinal direction from among the six perforations are at least 120° apart in the radial direction.

In an embodiment consistent with the second perforation cluster described above, a center of the third perforation is 180° apart in the radial direction from a center of the fourth perforation, and a center of the fifth perforation is 180° apart in the radial direction from a center of the sixth perforation.

In an embodiment consistent with the second perforation cluster described above, the third and fourth perforations are adjacent in the longitudinal direction, and the fifth and sixth perforations are adjacent in the longitudinal direction.

In an embodiment consistent with the second perforation cluster described above, the third and fourth perforations are on one side of the longitudinal section with respect to the first and second perforations, and the fifth and sixth perforations are on another side of the longitudinal section with respect to the first and second perforations.

In an embodiment consistent with the second perforation cluster described above, adjacent perforations in the longitudinal direction from among the six perforations are equidistant in the longitudinal direction.

In an embodiment consistent with the second perforation cluster described above, adjacent perforations in the radial direction from among the six perforations are equidistant in the radial direction, and adjacent perforations in the longitudinal direction and not adjacent in the radial direction.

In an embodiment consistent with the second perforation cluster described above, adjacent perforations in the longitudinal direction from among the six perforations are 120° or 180° apart in the radial direction.

Any combinations of the various embodiments and implementations disclosed herein can be used. These and other aspects and features can be appreciated from the following description of certain embodiments and the accompanying drawings and claims.

Figure 1B:
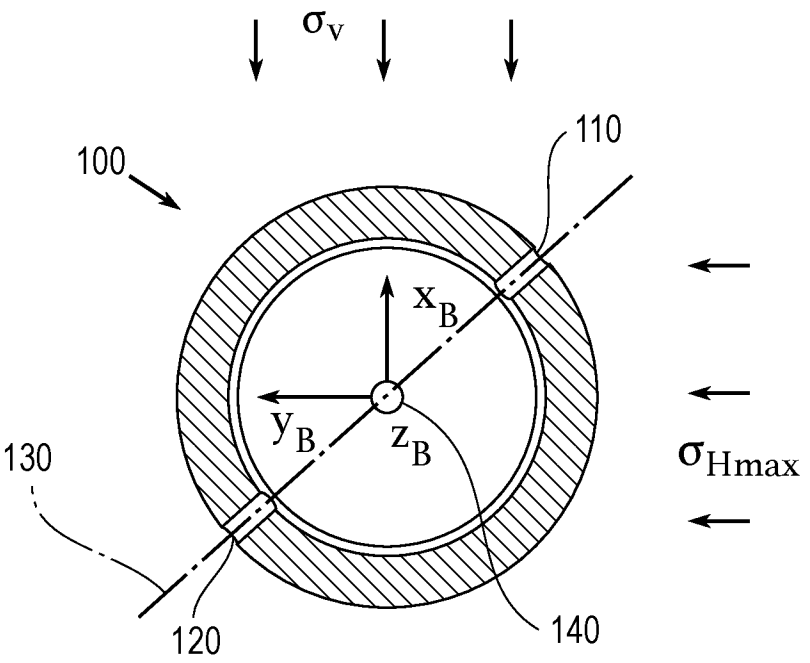
FIGS. 1A-1B are isometric and cross-sectional views, respectively, of an example wellbore with two perforations in the preferred or optimum direction (e.g., having the lowest breakdown pressure of the subsurface) and 180° apart in the radial direction, according to an embodiment.

It is noted that the drawings are illustrative and not necessarily to scale.

DETAILED DESCRIPTION OF CERTAIN EMBODIMENTS OF THE DISCLOSURE

Example embodiments of the present disclosure are directed to a perforation cluster of a longitudinal section (such as a horizontal section) of a wellbore. The wellbore is used for hydraulic fracturing (or fracking) of a subsurface surrounding the longitudinal section. The perforation cluster uses oriented perforation to lower the breakdown pressure needed to carry out the hydraulic fracturing. The orientation can be a preferred direction, such as a known or predetermined direction, as in an optimum direction or direction needing the lowest breakdown pressure (e.g., as determined by an algorithm or other technique to determine the lowest breakdown pressure). Here, the perforation orientation can be for deviated, cased hole, and clustered perforations. This orientation is referred to as the "preferred orientation" or "preferred direction" throughout, and represents a direction having a desired property, such as the orientation or direction requiring the lowest breakdown pressure to initiate hydraulic fractures from a perforation cluster at the wellbore. Once the preferred perforation direction is obtained, the perforation cluster has two perforation tunnels (or perforations) generated, aligned, or otherwise fabricated or placed in the preferred direction. The two perforation tunnels have a phase angle difference of 180° in the radial direction. These two perforation tunnels form the basis of the perforation cluster and have a desired property, such as the highest chance to initiate fractures (based on the required breakdown pressure). Additional perforation tunnels are added to form the perforation cluster.

As discussed earlier, hydraulic fracture initiation can be a challenging issue for deep and tight gas reservoirs. The size and layout of the perforations in the perforation cluster play a crucial role in the effectiveness of the hydraulic fracturing, especially for an easy fracture initiation. Having too big or too many perforations decreases the injection pressure, which can degrade effectiveness, while having too small or too few perforations decreases the likelihood of finding acceptable fracture sites, which also degrades effectiveness. Based on mechanics, not all of the perforation tunnels in the perforation cluster initiate hydraulic fractures. In most cases, only a few perforation tunnels end up being active and likely to initiate fractures.

Accordingly, in various example embodiments, a perforation cluster of a longitudinal section of a wellbore is provided. Once the preferred (e.g., optimum) perforation direction is calculated, determined, or otherwise known, the two perforations in this direction are created or placed. These perforations (preferred perforations) have the largest diameters of all the perforations in the cluster, with all the other perforations being smaller. This nonuniform perforation diameter design helps ensure enough injection fluids flow into the preferred or optimum oriented perforation tunnels. The two perforation tunnels aligning in the preferred or optimum perforation direction have a larger perforation diameter compared to the rest of the perforation tunnels in the perforation cluster. In addition, the two perforation tunnels aligned in the preferred or optimum direction are placed close to each other, such as adjacent in the longitudinal (lengthwise) direction of the longitudinal section of the wellbore. That is, there are no other perforation tunnels between them (in the longitudinal direction). The remaining perforations are spaced apart (or separated) in both the longitudinal and radial directions along and about the longitudinal axis of the longitudinal section.

All these help alleviate near wellbore fracture tortuosity issues and minimize flow restriction during hydraulic fracturing treatment. Otherwise, multiple reoriented nonplanar fractures can originate from the wellbore perforation cluster, which can lead to premature screen-out and negatively impact the fluid injection potential to achieve a desired stimulation performance. By combining the perforation cluster layout design and its relative orientation in the subsurface, example embodiments can reduce the number of perforation tunnels required for each perforation cluster versus what is currently used in hydraulic fracturing treatments.

According to some embodiments, a perforation cluster layout for hydraulic fracturing is provided. The layout uses nonuniform perforation diameters for the perforations within the cluster. This helps ensure the injection fluids flow into the preferred or optimum perforation tunnels (such as the perforation tunnels oriented in the preferred or optimum direction). There are two such preferred or optimum perforation tunnels in the cluster, spaced 180° apart in the radial direction and adjacent in the longitudinal direction. The preferred or optimum perforations have a larger diameter than the other perforations in the cluster. Here, the preferred or optimum direction can be, for example, determined to be the direction having the lowest breakdown pressure of the subsurface from among all the potential phase angles or directions ranging from 0° to 360° with respect to the longitudinal axis. This perforation cluster layout can lower or minimize the required breakdown pressure while also attracting enough injection fluids flowing into the two ideal perforations. This can help make the fracture initiation smoother and easier compared to other perforation cluster layouts.

According to some embodiments, the preferred direction is an optimum direction, such as computed or otherwise known or determined (e.g., using an algorithm to determine the optimum perforation orientation for a geologic setting and in-situ stress state). In some such embodiments, the preferred or optimum perforation orientation is that pair of radial directions (180° apart) whose corresponding perforations are most likely to initiate hydraulic fractures from a perforation cluster at the minimum required breakdown pressure. Using larger perforation diameters for the preferentially- or optimally-oriented perforations helps further ensure injection fluids flow into the preferred or optimum perforation tunnels. In addition, the optimally-oriented perforations are close to each other, such as adjacent to each other in the lateral direction (no other perforations in between). This can alleviate the near wellbore tortuosity otherwise present when using perforation clusters.

According to some embodiments, a perforation cluster layout design is presented. The design uses non-uniform perforation diameters for a perforation cluster, such as one size (e.g., a large diameter) for those perforations oriented in an optimum or preferred direction, and another size (e.g., a small diameter) for the remaining perforations, which are not oriented in the optimum or preferred direction. In some such embodiments, the perforation cluster includes two perforation tunnels aligned in the optimum or preferred perforation direction and having a larger perforation diameter, and the remaining perforation tunnels in the wellbore section having a smaller perforation diameter. In some such embodiments, the two perforation tunnels aligned in the optimum or preferred perforation direction are close to each other, such as next to each other in the longitudinal direction along the wellbore section where the perforation cluster is located. Together, these features help ensure injection fluids can easily flow into the perforation tunnels that require relatively low breakdown pressures. In some such embodiments, these features are part of a well completion method that improves breakdown issues for hydraulic fracturing treatments in deep and tight gas reservoirs. In addition, these features can alleviate the near wellbore fracture tortuosity issue.

Figure 1A:
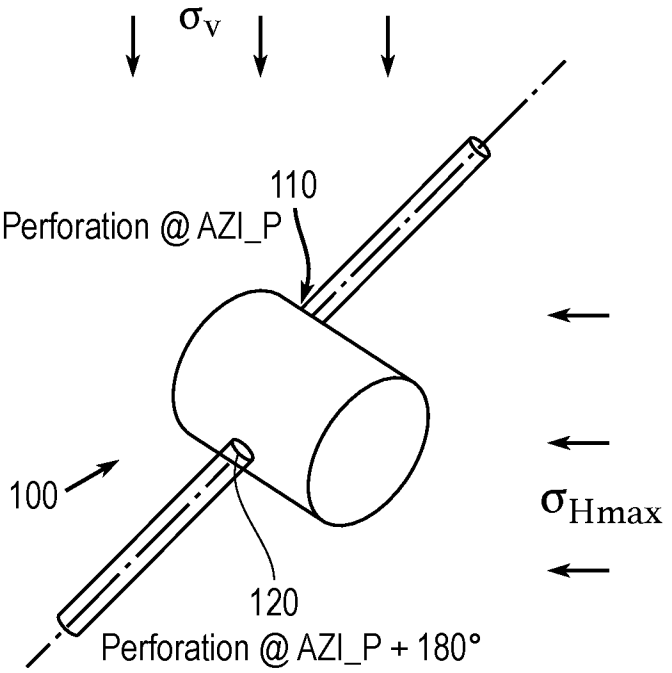

FIGS. 1A-1B are isometric and cross-sectional views, respectively, of an example wellbore 100 with two perforations 110 and 120 in the preferred or optimum direction 130 (e.g., having the lowest breakdown pressure of the subsurface) and 180° apart in the radial direction, according to an embodiment. For instance, in FIGS. 1A-1B, the main perforation direction can be based on the prediction of the minimum required breakdown pressure in the subsurface surrounding the wellbore 100. Here, the direction can be a radial direction relative to the longitudinal axis 140 running through the wellbore 100.

Hydraulic fracture initiation is critical for hydraulic fracturing treatments in deep and tight gas reservoirs. Otherwise, deleterious side effects can take place, such as the main pump schedule not being injected as planned. Fracture initiation can be a challenging issue for deep and tight gas reservoirs, which generally require a high breakdown pressure. In FIGS. 1A-1B, oriented perforations 110 and 120 are used to lower required breakdown pressure. Here, the optimum perforation direction or orientation 130 is defined as the direction or orientation along which the perforation tunnels need the minimum breakdown pressure for a specific geologic setting and in-situ stress state compared to perforations in other directions or orientations.

In example embodiments, the preferred or optimal oriented perforation direction can be that direction that requires the minimum breakdown pressure to initiate fractures (e.g., as known, computed, or otherwise determined). In downhole fracking operations such as illustrated in wellbore 100 of FIGS. 1A-1B, there are two perforation tunnels 110 and 120 close to each other (e.g., as measured along the longitudinal axis 140, such as adjacent in the longitudinal direction) and perforated along the preferred or optimum perforation direction. One of the perforations (first perforation 110) is perforated in the obtained perforation azimuth Perf_AZI (e.g., as calculated or otherwise determined), and the other perforation (second perforation 120) is perforated in the opposite direction Perf_AZI+180°, which produces a phase angle difference of 180° in the radial direction about longitudinal axis 140.

Once the optimum perforation direction for a perforation cluster is determined, the next task is to ensure two perforation tunnels can align in the optimum perforation direction. This can be achieved through a downhole perforation control system. Perforation clusters for hydraulic fracturing treatments usually use perforations having the same diameter, and in a longitudinal spiral order, which can lead to near wellbore fracture tortuosity and premature screen-out. According to some embodiments of the present disclosure, however, both optimal perforations are included in the perforation cluster, they have larger diameters than the non-optimal perforations, and they are adjacent to each other in the longitudinal direction.

Figure 2A:
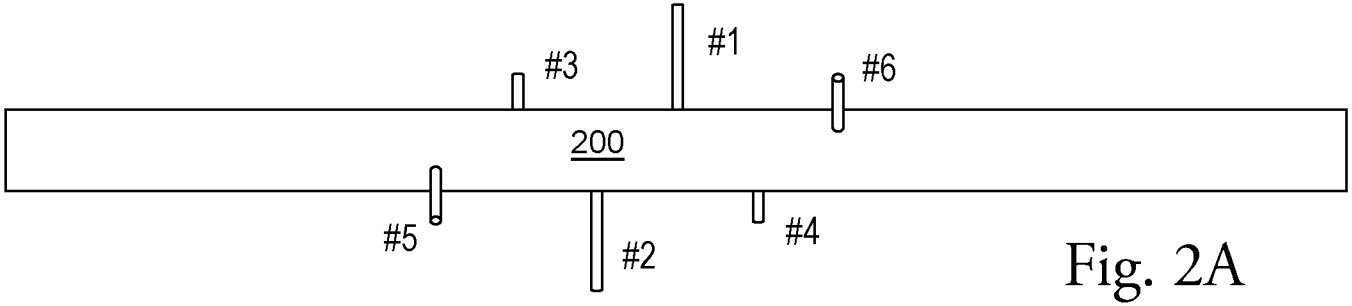
FIGS. 2A-2C are top, side, and bottom views, respectively, of an example perforation cluster of a longitudinal section of a wellbore, according to an embodiment.
Figure 2B:
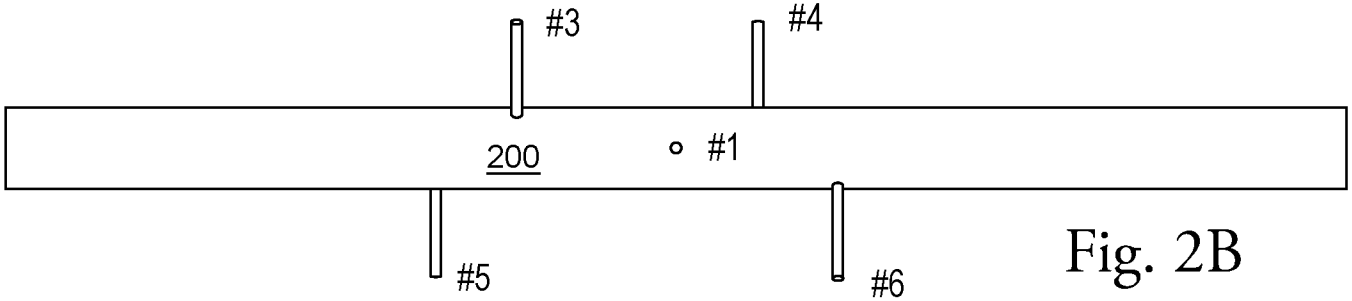
Figure 2C:
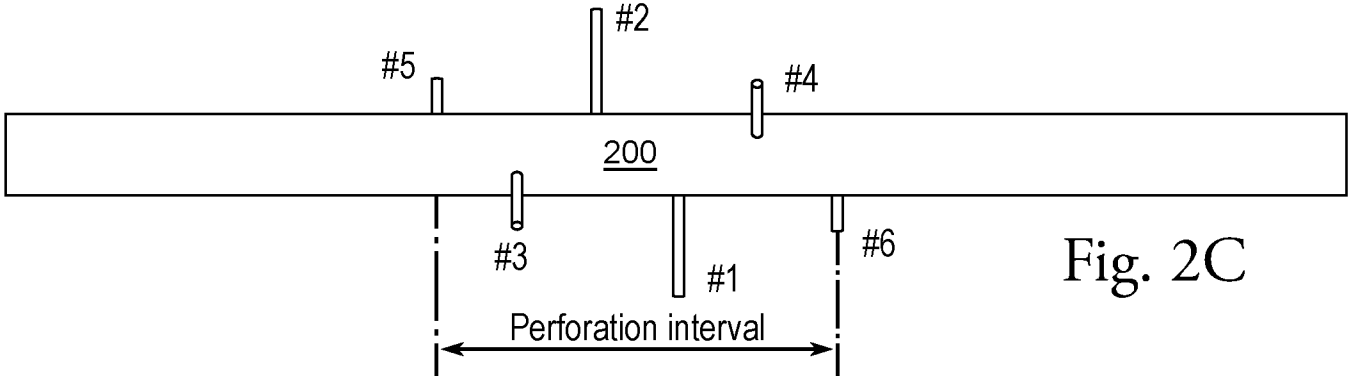
Figure 2D:
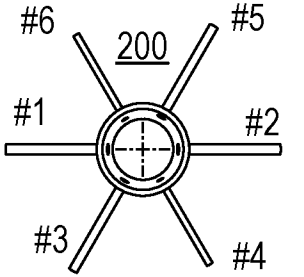
FIGS. 2D-2E are example cross-sectional views of the perforation cluster of FIGS. 2A-2C, according to embodiments.
Figure 2E:
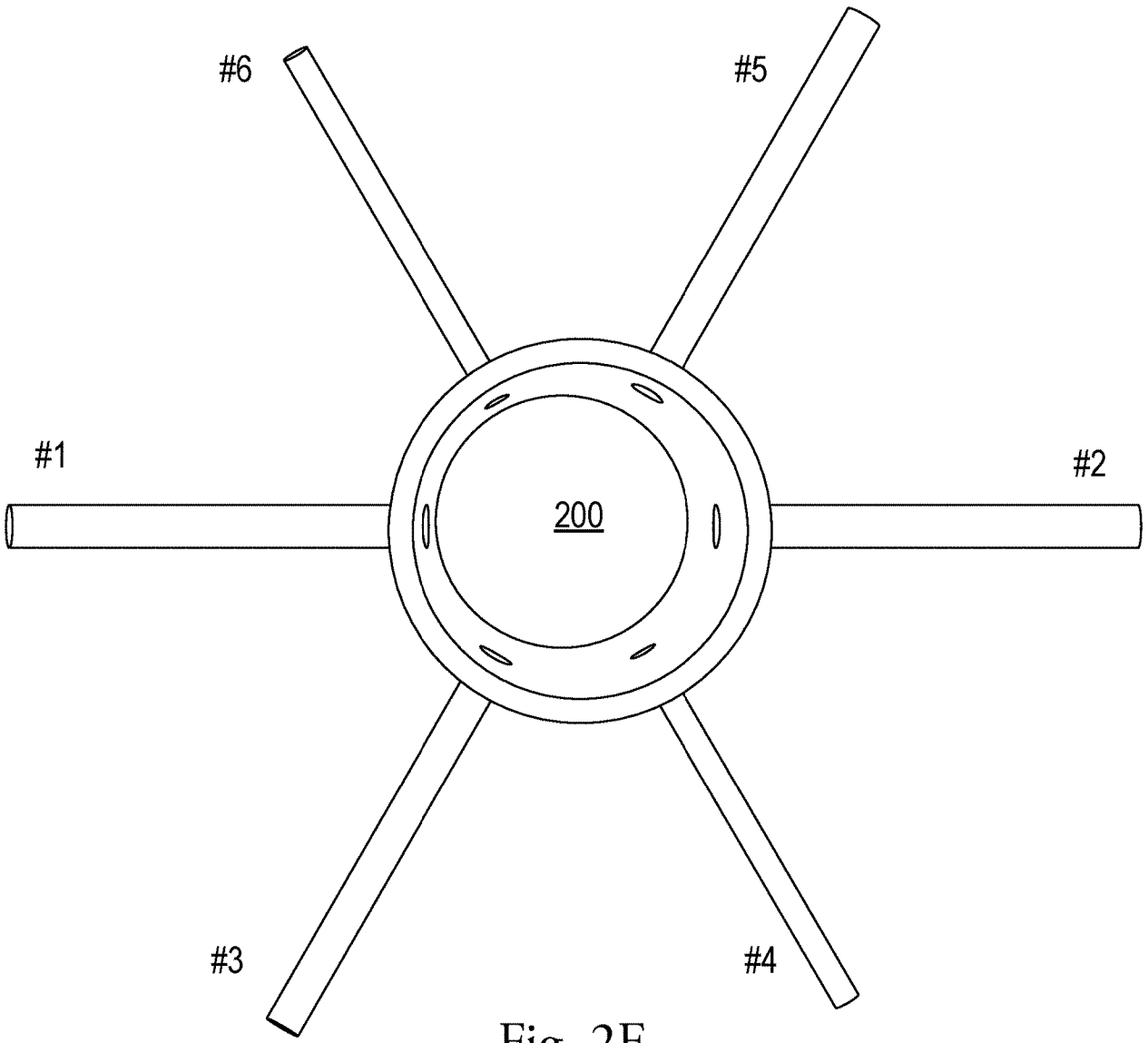
Figure 2F:
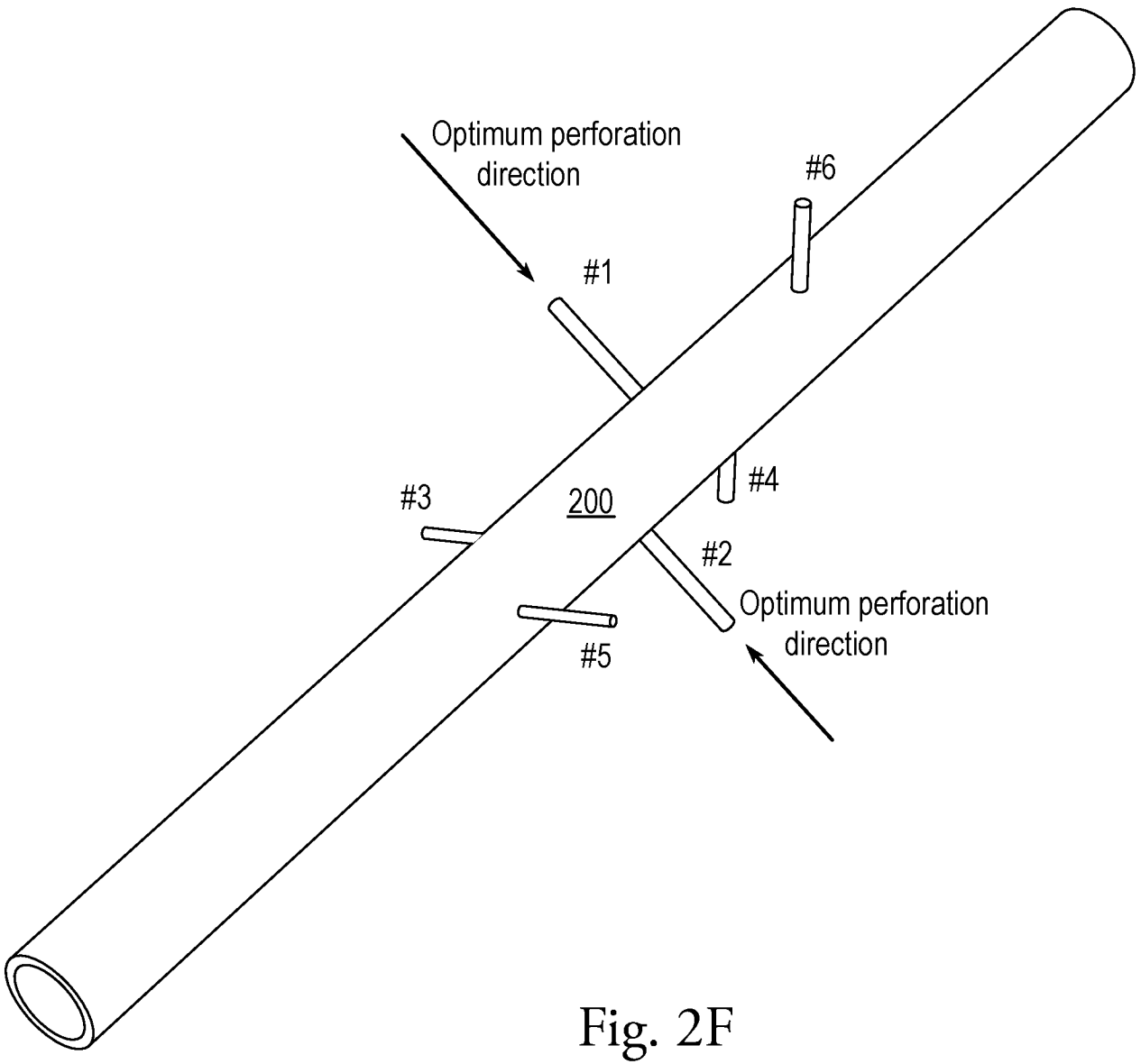
FIG. 2F is an example oblique view of the perforation cluster of FIGS. 2A-2E, according to an embodiment.

FIGS. 2A-2C are top, side, and bottom views, respectively, of an example perforation cluster 200 of a longitudinal section of a wellbore, according to an embodiment. FIGS. 2D-2E are example cross-sectional views of the perforation cluster 200 of FIGS. 2A-2C, according to embodiments. FIG. 2F is an example oblique view of the perforation cluster 200 of FIGS. 2A-2E, according to an embodiment. The perforation cluster 200 includes six perforation tunnels (perforations) labeled #1 through #6 and that are separated (or spaced apart) in both the longitudinal and radial directions. Perforations #1 and #2 are oriented in the preferred or optimum direction, 180° apart in the radial direction, adjacent in the longitudinal direction, and have larger diameters than the other perforations. Perforations #3 and #5 are on one side of the perforation cluster 200 (as defined by perforations #1 and #2), 180° apart in the radial direction, and adjacent in the longitudinal direction. Perforations #4 and #6 have the same attributes as perforations #3 and #5, only they are on the other side of the perforation cluster 200. The perforations are equidistant in the longitudinal and radial directions, but adjacent perforations in the longitudinal direction are 120° or 180° apart (not adjacent) in the radial direction.

FIG. 2F illustrates the perforation cluster 200 in a subsurface geologic setting. In the perforation cluster 200 of FIGS. 2A-2F, the two perforation tunnels numbered #1 and #2 in the middle of the perforation cluster 200 have larger perforation diameters, while the remaining perforation tunnels numbered #3 through #6 have smaller perforation diameters. In addition, perforation tunnels #1 and #2 are close to each other (e.g., adjacent in the longitudinal direction) and have a phase angle difference of 180° in the radial direction. Further, perforation tunnels #1 and #2 are aligned in the preferred or optimum perforation direction (e.g., as based on the calculation for a well trajectory and subsurface in-situ stress state), which lowers or minimizes the required breakdown pressure.

The design of the perforation cluster 200 together with the oriented perforation has numerous features. First, the perforation cluster 200 uses non-uniform perforation diameters, where the two perforation tunnels #1 and #2 aligning in the preferred or optimum perforation direction have relatively large perforation diameter while the remaining perforation tunnels #3 through #6 use relatively small diameters. This intentionally helps ensure injection fluids flow into the perforation tunnels aligned in the preferred or optimum perforation direction as much as possible, which boosts the success rate of any breakdown issues. Second, the two perforation tunnels aligned in the preferred or optimum perforation direction are next and closest to each other along the wellbore (e.g., adjacent in the longitudinal direction). This helps alleviate the near wellbore fracture tortuosity issue, minimize flow restrictions, and minimize friction pressure loss during hydraulic fracturing. Otherwise, multiple reoriented nonplanar fractures can originate from the wellbore perforation cluster, which likely leads to premature screen-out and negatively impacts the fluid injection potential to achieve a desired stimulation performance.

Furthermore, combining the perforation cluster layout design and its relative orientation in the subsurface reduces the number of perforation tunnels required for each perforation cluster, unlike currently used perforation clusters in hydraulic fracturing treatments. In summary, in example embodiments, the perforation cluster layout designs further enhance the hydraulic fracturing treatment when the perforation clusters are aligned in the preferred or optimum perforation direction, (e.g., as calculated based on the well trajectory and subsurface in-situ stress state).

Figure 3:
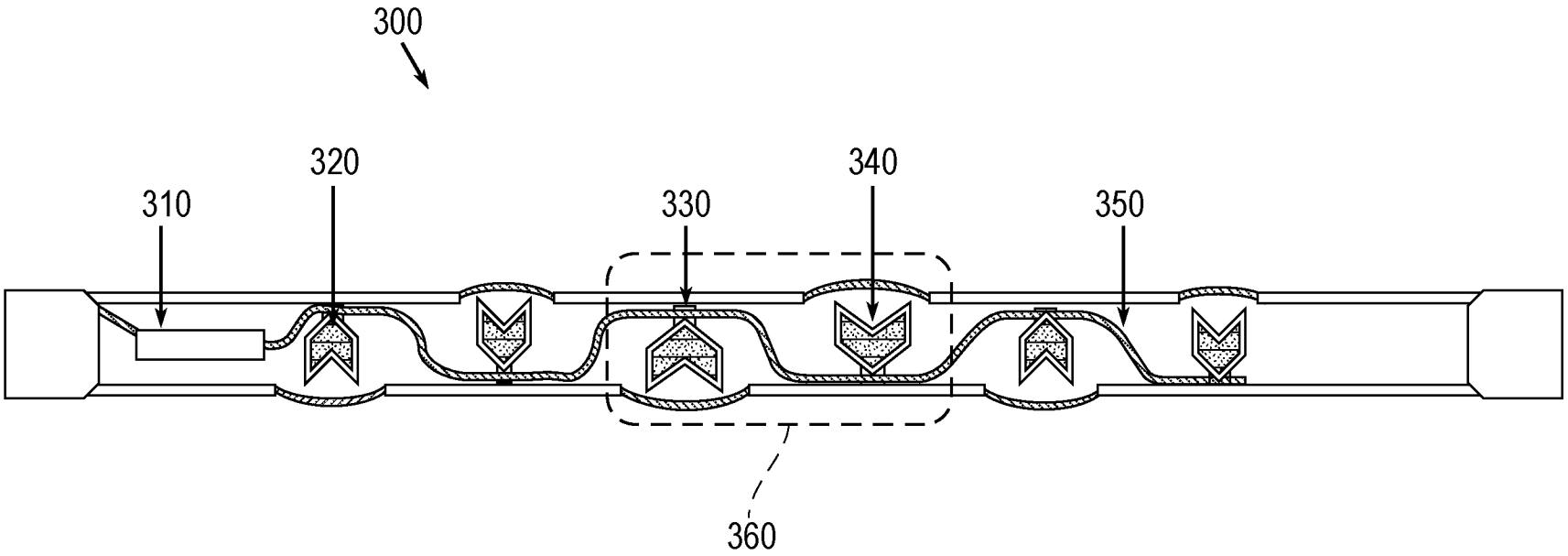
FIG. 3 is a schematic view of an example explosive arrangement for fabricating a perforation cluster in a wellbore, such as the perforation cluster of FIG. 2, according to an embodiment.

FIG. 3 is a schematic view of an example explosive arrangement 300 for fabricating a perforation cluster in a wellbore, such as the perforation cluster 200 in FIG. 2, according to an embodiment. The explosive arrangement 300 includes six shaped charges connected to a detonator 310 by a detonator cord 350. Each shaped charge includes high explosive 320 designed to be set off by an explosive charge 330 connected to the detonator cord 350. Each shaped charge further includes a conical liner 340 to direct the charge to a desired portion of the wellbore. The two central charges in the more explosive region 360 are larger than the remaining charges on either side of the central charges. This is to create a perforation pattern in the wellbore whose central perforations have a larger diameter than the remaining perforations on either side of the central perforations.

In further detail, in order to generate the desired perforation cluster layout design (such as the perforation cluster 200 in FIG. 2), the shaped charge layout in the perforating gun needs to be adjusted. Perforating guns are usually made up of a number of shaped charges. The shaped charges generally have a metal liner on the charge cavity. In the shaped charge layout 300 of FIG. 3, the two shaped charges in the middle use relatively large bullets or are set off with more powder (e.g., more explosive powder), which enables them to generate relatively large-diameter perforation tunnels compared to the remaining shaped charges.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the scope of the present disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing, and are not to be construed as limiting. However, it is recognized these terms could be used with reference to a viewer. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

While the disclosure has described several exemplary embodiments, it will be understood by those skilled in the art that various changes may be made, and equivalents may be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims.

What is claimed is:

1. A longitudinal section of a wellbore, comprising:

a perforation cluster for hydraulic fracturing in a preferred direction of a subsurface surrounding the longitudinal section, wherein the longitudinal section has a longitudinal axis in a longitudinal direction and defining a radial direction about the longitudinal axis, wherein the perforation cluster comprises all of six perforations of the wellbore within the longitudinal section, wherein the six perforations are separated in the longitudinal and radial directions, wherein the six perforations comprise a first perforation, a second perforation, a third perforation, a fourth perforation, a fifth perforation, and a sixth perforation, wherein the first and second perforations are adjacent in the longitudinal direction, have a first diameter in the wellbore, and have respective centers that are aligned in the preferred direction with respect to the longitudinal axis and 180° apart in the radial direction, for initiating fractures through hydraulic fracturing in the subsurface, wherein the third, fourth, fifth, and sixth perforations have smaller diameters in the wellbore than the first diameter, wherein the first and second perforations are placed adjacent in the longitudinal direction with none of the third, fourth, fifth, or sixth perforations being between the first and second perforations in the longitudinal direction, and wherein adjacent perforations in the longitudinal direction from among the six perforations are at least 90° apart in the radial direction.

2. The perforation cluster of claim 1, wherein the longitudinal section is a horizontal portion of the wellbore with respect to gravity.

3. The perforation cluster of claim 1, wherein adjacent perforations in the longitudinal direction from among the six perforations are at least 120° apart in the radial direction.

4. The perforation cluster of claim 1, wherein a center of the third perforation is 180° apart in the radial direction from a center of the fourth perforation, and wherein a center of the fifth perforation is 180° apart in the radial direction from a center of the sixth perforation.

5. The perforation cluster of claim 4, wherein the third and fourth perforations are adjacent in the longitudinal direction, and wherein the fifth and sixth perforations are adjacent in the longitudinal direction.

6. The perforation cluster of claim 5, wherein the third and fourth perforations are on one side of the longitudinal section with respect to the first and second perforations, and wherein the fifth and sixth perforations are on another side of the longitudinal section with respect to the first and second perforations.

7. The perforation cluster of claim 6, wherein adjacent perforations in the longitudinal direction from among the six perforations are equidistant in the longitudinal direction.

8. The perforation cluster of claim 6, wherein adjacent perforations in the radial direction from among the six perforations are equidistant in the radial direction, and wherein adjacent perforations in the longitudinal direction from among the six perforations are not adjacent in the radial direction.

9. The perforation cluster of claim 6, wherein adjacent perforations in the longitudinal direction from among the six perforations are 120° or 180° apart in the radial direction.

* * * * *